US005870898A

United States Patent [19]

Choi

[11] Patent Number: 5,870,898

[45] Date of Patent: Feb. 16, 1999

[54] METHOD AND APPARATUS FOR CONTROLLING DRIVING OF AIR CURTAIN FAN

[75] Inventor: Byung-Jun Choi, Incheon, Rep. of Korea

[73] Assignee: Daewoo Electronics Co., Ltd., Seoul, Rep. of Korea

[21] Appl. No.: 984,145

[22] Filed: Dec. 3, 1997

[30] Foreign Application Priority Data

Dec. 27, 1996 [KR] Rep. of Korea ..... 1996-73822

[51] Int. Cl.[6] ..... F24F 9/00; A47F 3/04

[52] U.S. Cl. ..... 62/89; 62/131; 62/256; 454/188

[58] Field of Search ..... 454/188; 62/131, 62/89, 256, 188

[56] References Cited

U.S. PATENT DOCUMENTS

| | | | |
|---|---|---|---|
| 4,379,391 | 4/1983 | Rhee | 62/256 X |
| 5,263,332 | 11/1993 | Park | 62/131 X |
| 5,784,895 | 7/1998 | Choi | 62/256 X |
| 5,791,152 | 8/1998 | Choi | 62/256 X |

*Primary Examiner*—William Wayner
*Attorney, Agent, or Firm*—Beveridge, DeGrandi, Weilacher & Young, LLP

[57] ABSTRACT

An air curtain fan driving controlling method and apparatus control a driving of an air curtain based on the temperature inside a refrigerating compartment of a refrigerator and the temperature outside a refrigerating compartment thereof. In the method, a reference temperature for controlling a temperature inside a refrigerating compartment is set. The normal cool operation for the refrigerating compartment is executed. It is judged whether an open door for the refrigerating compartment is detected during the normal cooling operating. In the previous step, when the door-close is detected, the temperature inside the refrigerating compartment and the temperature outside the refrigerating compartment is detected. An absolute value between a difference of the temperature inside a refrigerating compartment and the temperature outside the refrigerating compartment is compared with the set reference temperature to control a driving of the air curtain fan. It is judged whether a door-close for the refrigerating compartment is detected. It is judged whether a closed door for the refrigerating compartment is detected to control the air curtain fan according to a result of the detection. In accordance with method and the apparatus, since an air curtain fan is driven based on the temperature inside a refrigerating compartment of a refrigerator and the temperature outside a refrigerating compartment thereof, the method and apparatus wastes less electric power than that of the conventional method.

6 Claims, 4 Drawing Sheets

METHOD AND APPARATUS FOR CONTROLLING DRIVING OF AIR CURTAIN FAN

BACKGROUND OF THE INVENTION

1. Field of the Invention

The present invention relates to a refrigerator, and more particularly to a method and an apparatus for controlling driving of an air curtain fan based on a temperature inside a refrigerating compartment of a refrigerator and a temperature outside a refrigerating compartment thereof.

2. Description of the Prior Art

In regard to a refrigerating cycle, when a high temperature and high pressure refrigerant gas generated by an compressor passes through a condenser it changes into a high pressure liquid refrigerant by discharging heat outside. Then, the high pressure liquid refrigerant passes through a dryer to remove impurities and water included therein and is supplied to a capillary tube. The liquid refrigerant passed through the capillary tube is expanded into an evaporable gas-liquid mixing state and is fed to an evaporator. The refrigerant in a evaporable gas-liquid mixing state absorbs a peripheral heat and returns to an original state so that the circulation of the cool air repeats.

Currently, during the operation of a refrigerator, an overload is applied to an inside of the refrigerating compartment or external air flows to the inside of the refrigerating compartment by an open door so that the temperature inside a refrigerating compartment increases. In the case described above, in order to recover the temperature inside the refrigerating compartment to a normal state, an air curtain fan is additively disposed inside the refrigerating compartment.

U.S. Pat. No. 5,263,332 (issued to Seong S. Park on Nov. 23, 1997) discloses a temperature control method for use in a refrigerator which enhances cooling efficiency by promptly restoring a variation of a load temperature caused by an open door. The patent of Seong S. Park includes a normal operation step for controlling a compressor and a fan to maintain a temperature inside a refrigerating compartment between a positive limit temperature and a negative limit temperature, both derived from a set temperature input by a user; a door-open is detected; a reset temperature setting step for setting a reset temperature based on the door-opening time; and a reset temperature operation step for executing a cooling operation by driving a compressor and a fan until the temperature inside the refrigerating compartment decreases to the reset temperature, lower than the set temperature, if it is desired during the normal operation that the reset temperature has been reset. The method enhances the refrigerating efficiency of a refrigerator by promptly restoring the temperature of food contained in the refrigerating compartment which has risen by external air flowing into the refrigerating compartment as a result of an open door.

Hereinafter, a conventional apparatus 10 for controlling a driving of an air curtain fan will be described with reference to FIG. 1. FIG. 1 shows a conventional apparatus for controlling a driving of an air curtain fan. The conventional apparatus 10 includes a temperature detector 102, a compressor 104, a compressor driver 106, a refrigerating fan 108, a refrigerating fan driver 110, an air curtain fan driver 112, and a control section 114.

The temperature detector 102 detects a temperature $T_I$ inside a refrigerating compartment under the control of the control section 114. The detected temperature $T_I$ inside the refrigerating compartment is applied to the control section 114. The compressor 104 generates a high temperature and high pressure refrigerant gas. The compressor driver 106 controls a driving of the compressor 104. The refrigerating fan 108 blows a cool air supplied by an evaporator (not shown) into a refrigerating compartment. The refrigerating fan driver 110 controls a driving of the refrigerating fan 108. The air curtain fan driver 112 controls a driving of the air curtain fan 100.

The control section 114 controls an operation of a temperature detector 102, a compressor driver 106, and a refrigerating fan driver 110, an air curtain fan driver 112 The control section 114 executes the normal cool operation by driving a compressor 104 and a refrigerating fan 108 via a compressor driver 106 and a refrigerating fan 110, and judges whether the detected temperature $T_I$ inside the refrigerating compartment from the temperature detector is a normal temperature.

An operation of the conventional air curtain fan driving apparatus will not be illustrated. FIG. 2 is a flow chart for performing the conventional apparatus for controlling a driving of an air curtain fan in FIG. 1.

Electric power is supplied to respective units, the control section 114 executes the normal cool operation (step S201) by driving a compressor 104 and a refrigerating fan 108 via a compressor driver 106 and a refrigerating fan 110. In step S202, the temperature detector 102 detects a temperature $T_I$ inside a refrigerating compartment under the control of the control section 114. The detected temperature $T_I$ inside the refrigerating compartment is applied to the control section 114.

In step S203, the control section 114 judges whether the the detected temperature $T_I$ inside the refrigerating compartment from the temperature detector 102 is a normal temperature $T_N$. As a result of the judgement in step S203, when it is judged that the temperature $T_I$ inside a refrigerating compartment is not the normal temperature $T_N$, the compressor driver 106 drives the compressor 104 under the control of the control section 114 (step S204).

Subsequently, the refrigerating fan driver 108 and the air curtain fan driver 112 drive the refrigerating fan 108 and the air curtain fan 100 under the control of the control section 114, respectively (step S205). In step S206, the control section again judges whether the detected temperature $T_I$ inside the refrigerating compartment from the temperature detector is the normal temperature.

As a result of the judgement in step S206, when it is judged that the temperature $T_I$ inside a refrigerating compartment is not the normal temperature, the routine returns to step S204.

On the other hand, when the temperature $T_I$ inside a refrigerating compartment is the normal temperature in step S206, or when it is judged that the temperature $T_I$ inside a refrigerating compartment is the normal temperature, the control section executes a normal operation (step S207) and the entire operation finishes.

In accordance with the conventional method, when a door is opened, an air curtain is driven regardless of the temperature inside a refrigerating compartment or the temperature outside temperature. Accordingly, the air curtain fan is driven beyond need so that electric power is unnecessarily wasted.

SUMMARY OF THE INVENTION

The present invention is devised to solve the foregoing problems. A first object of the present invention is to provide a method for controlling a driving of an air curtain fan based on the temperature inside a refrigerating compartment of a refrigerator and the temperature outside a refrigerating compartment thereof.

A second object of the present invention is to provide an apparatus for controlling a driving of an air curtain fan based on the temperature inside a refrigerating compartment of a refrigerator and the temperature outside a refrigerating compartment thereof.

To achieve the first object of the present invention, there is provided a method for controlling of driving an air curtain fan, the method comprising the steps of:

a) setting a reference temperature for controlling a temperature inside a refrigerating compartment of a refrigerator;

b) executing the normal cool operating for the freezer compartment;

c) judging whether an open door for the refrigerating compartment is detected during a normal cooling operating;

d) executing step b) when the door-open is detected, and detecting a temperature inside a refrigerating compartment and a temperature outside the refrigerating compartment when the door-close is detected, as a result of the detection in step c);

e) comparing an absolute value of a difference between the temperature inside a refrigerating compartment and the temperature outside the refrigerating compartment with the set reference temperature to control a driving of the air curtain fan; and f) judging whether a closed door for the refrigerating compartment is detected to control the air curtain fan according to a result of the detection.

In order to achieve the second object of the present invention, there is provided an apparatus for controlling a driving of an air curtain fan, the apparatus comprising:

a temperature set section for setting a reference temperature for controlling a temperature inside a refrigerating compartment of a refrigerator;

a door detector for detecting an open/close state of a door of the refrigerating compartment;

first and second temperature detectors for detecting the temperature inside the refrigerating compartment and a temperature outside the refrigerating compartment, respectively;

an air curtain driver for controlling a driving of the air curtain fan;

a control section for executing a normal cool operating of the refrigerating compartment, judging whether the door detector detects an open door during the normal cooling operation, calculating an absolute value of a difference between the temperature inside the refrigerating compartment and the temperature outside the refrigerating compartment based on the temperatures inside and outside the refrigerating compartment detected by the first and second temperature detectors, respectively, comparing the calculated absolute value with the reference temperature set by the temperature set section to control an operation of the air curtain fan driver according to the comparison result.

According to the present invention, since an air curtain fan is driven based on a temperature inside a refrigerating compartment of a refrigerator and a temperature outside a refrigerating compartment thereof, the present invention does not drive the air curtain fan beyond need but wastes less electric power than that of the conventional method.

BRIEF DESCRIPTION OF THE DRAWINGS

The above object and other advantages of the present invention will become more apparent by describing in detail preferred embodiment thereof with reference to the attached drawings in which.

DETAILED DESCRIPTION OF THE PREFERRED EMBODIMENT

Figure 1:
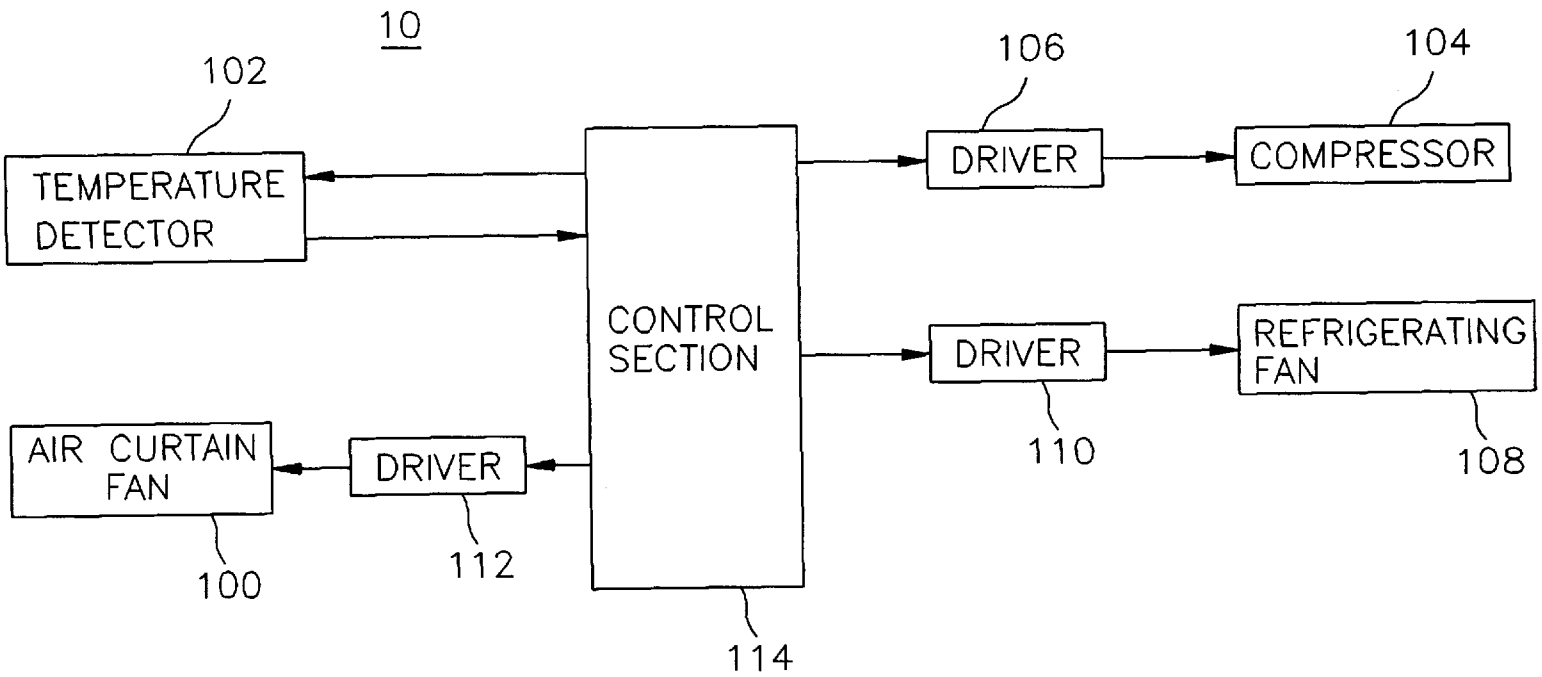
FIG. 1 PRIOR ART
FIG. 1 is a block diagram of showing a conventional apparatus for driving an air curtain fan.
Figure 2:
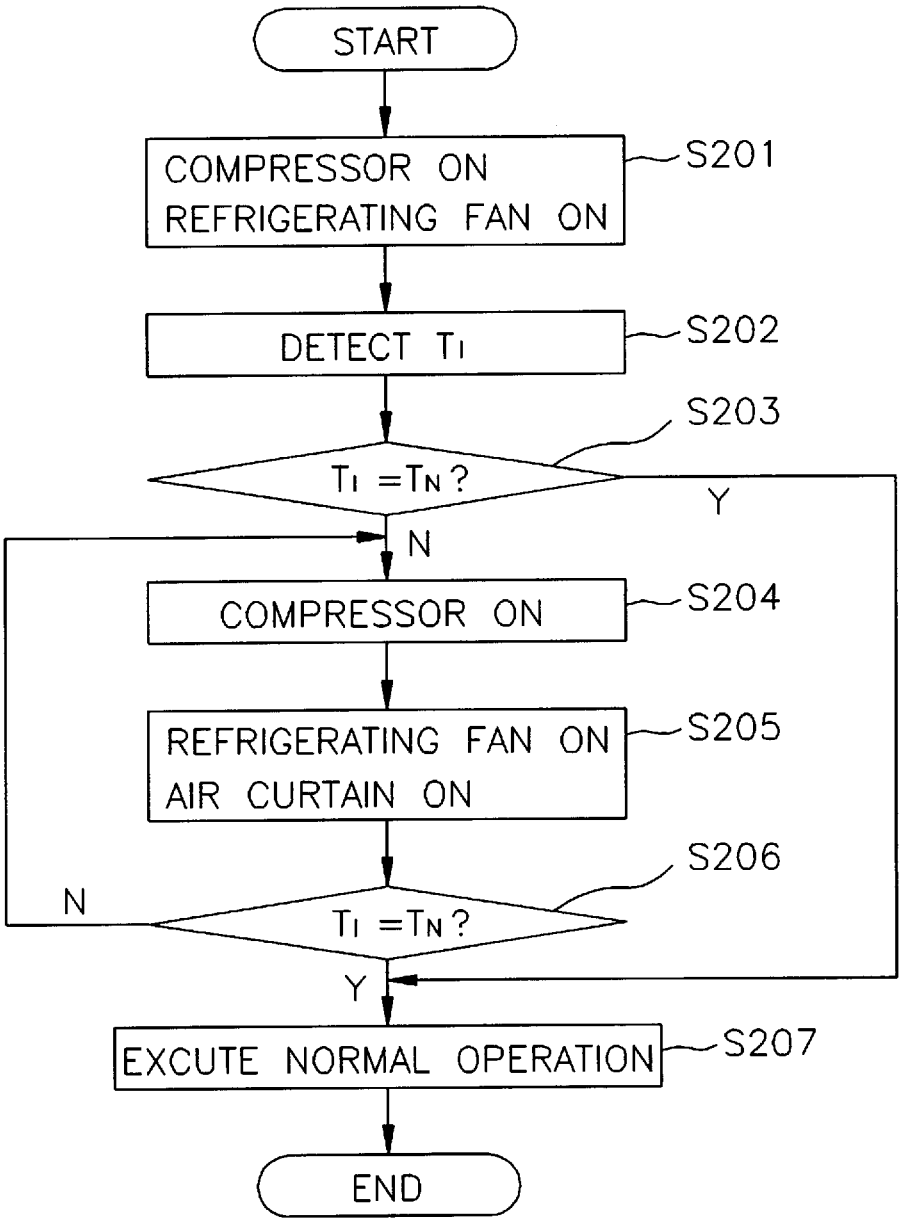
FIG. 2 PRIOR ART
FIG. 2 is a flow chart for performing the conventional apparatus for driving an air curtain fan in FIG. 1.
Figure 3:
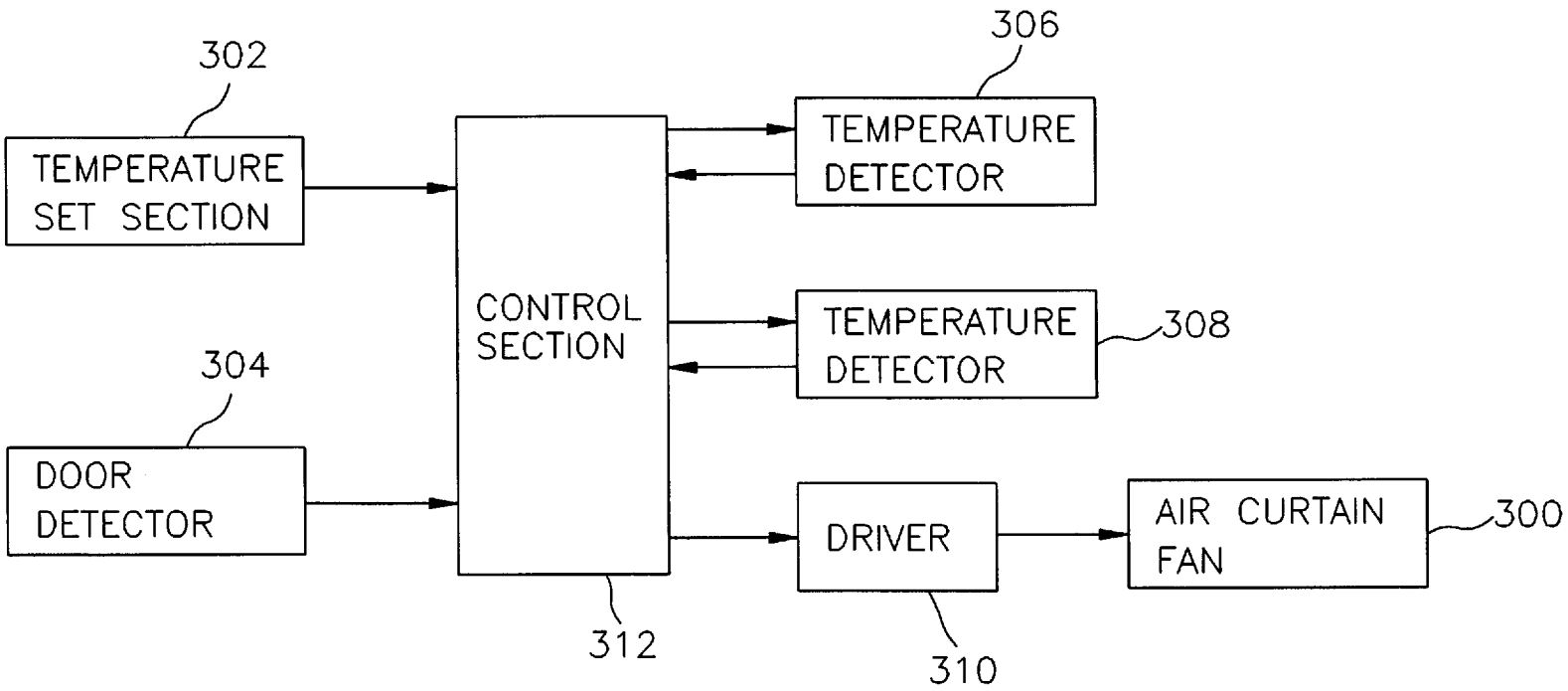
FIG. 3 is a block diagram for showing a configuration of an apparatus for driving an air curtain fan according to an embodiment of the present invention.

Hereinafter, the first embodiment of the present invention will be described in detail with reference to the accompanying drawings. FIG. 3 shows a configuration of an apparatus 30 for driving an air curtain fan according to an embodiment of the present invention. The apparatus 30 includes a temperature set section 302, a door detector 304, a first temperature detector 306, a second detector 308, an air curtain fan driver 310, and a control section 312.

The temperature set section 302 sets a reference temperature $T_R$ for controlling a temperature $T_I$ inside a refrigerating compartment by an operation of a user. The door detector 304 detects an open/close state of a refrigerating compartment door. The first temperature detector 306 detects the temperature $T_I$ inside the refrigerating compartment. The second temperature detector 308 detects the temperature $T_O$ outside the refrigerating compartment. The temperatures $T_I$ and $T_O$ are applied to the control section 312. The air curtain driver 310 controls a driving of the air curtain fan 300.

The control section 312 executes a normal cool operating of the refrigerating compartment, and judges whether the door detector 304 detects an open door during the normal cooling operation. The control section 312 calculates an absolute value $T_D$ between a difference between the temperature $T_I$ inside the refrigerating compartment and the temperature $T_O$ outside the refrigerating compartment based on the temperatures $T_I$ and $T_O$ inside and outside the refrigerating compartment detected by the first and second temperature detectors 306 and 308, respectively, and compares the calculated absolute value with the reference temperature set by the temperature set section 302 to control an operation of the air curtain fan driver 310 according to the comparison result.

Figure 4:
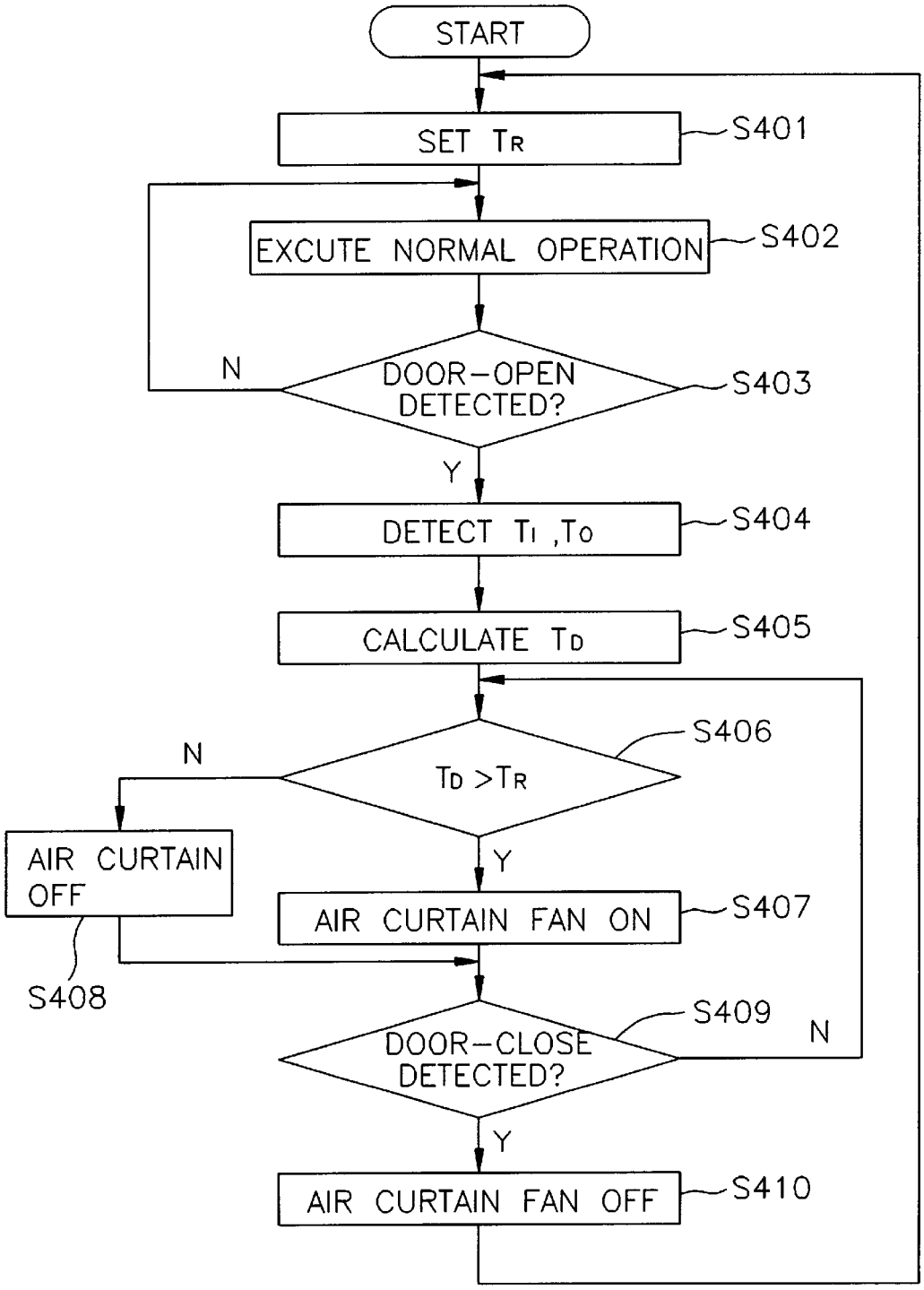
FIG. 4 is a flow chart for illustrating a method for driving an air curtain fan according to an embodiment of the present invention.

An operation of the apparatus and a method for controlling a driving of an air curtain fan according to an embodiment of the present invention will not be illustrated with reference to FIG. 4. FIG. 4 illustrates a method for driving an air curtain fan according to an embodiment of the present invention.

When a user sets a reference temperature $T_R$ for controlling a temperature $T_I$ inside a refrigerating compartment by an operation of the temperature set section 302, the set reference temperature $T_R$ is inputted to the control section 312 (step S401). Generally, since the temperature $T_I$ inside a refrigerating compartment is set as a temperature from 0° to 5° C., the reference temperature $T_R$ may be set at a temperature from 5° to 10° C. In step S402, the control section 312 executes the normal cool operating for a refrigerating compartment of a refrigerator by driving a compressor and a refrigerating fan (not shown).

In step S403, the conrol section 312 judges whether or not the door detector 304 detects an open door during the normal cooling operating. As a result of the detection in step S403, when it is judged that the open door is not detected the routine returns to the step S402. Alternatively, when the door-open is detected in step S403, the first and second temperature detectors 306 and 308 detect a temperature $T_I$ inside the refrigerating compartment and a temperature outside $T_O$ the refrigerating compartment under the control of the control section 312, respectively (step S404). The detected temperatures $T_I$ and $T_O$ inside and outside the refrigerating compartment are applied to the control section 312.

In step S405, the control section 312 calculates an absolute value $T_D$ of a difference between temperature $T_I$ inside a refrigerating compartment and a temperature outside $T_O$ the refrigerating compartment on the basis of the detected temperatures $T_I$ and $T_O$ inside and outside the refrigerating compartment from the first and second temperature detectors 306 and 308, respectively. In step S406, the control section 312 compares the absolute value $T_D$ between a difference of the temperature inside a refrigerating compartment and the temperature outside the refrigerating compartment with the reference temperature $T_R$ set by the temperature set section 302 in step S401.

As a result of the comparison in step S406, when the absolute value $T_D$ of the difference of the temperature $T_I$ inside a refrigerating compartment and the temperature $T_O$ outside the refrigerating compartment is greater than the set reference temperature $T_R$, the air curtain fan driver 310 drives the air curtain fan 300 under the control of the control section 312 (step S407). Alternatively, when the absolute value $T_D$ of the difference of the temperature $T_I$ inside the refrigerating compartment and the temperature $T_O$ outside the refrigerating compartment is smaller than or equal to the set reference temperature $T_R$ in step S406, the air curtain fan driver 310 stops the air curtain fan 300 under the control of the control section 312 (step S408).

In step S409, the conrol section 312 judges whether or not the door detector 304 detects a closed door. As a result of the detection in step S409, when it is judged that the door-close is not detected, the routine returns to the step S406. Alternatively, when the closed door is detected in step S409 the air curtain fan driver 310 stops the air curtain fan 300 under the control of the control section 312 (step S410) and the routine returns step S402.

As mentioned above, according to the present invention, since an air curtain fan is driven based on a temperature inside a refrigerating compartment of a refrigerator and a temperature outside a refrigerating compartment thereof, the present invention does not drive the air curtain fan beyond need but wastes less electric power than that of the conventional method.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A method for controlling of driving an air curtain fan, said method comprising the steps of:

a) setting a reference temperature for controlling a temperature inside a refrigerating compartment of a refrigerator;

b) executing the normal cool operating for the freezer compartment;

c) judging whether an open door for the refrigerating compartment is detected during a normal cooling operating;

d) executing step b) when the door-open is detected, and detecting a temperature inside a refrigerating compartment and a temperature outside the refrigerating compartment when the door-close is detected, as a result of the detection in step c);

e) comparing an absolute value of a difference between the temperature inside a refrigerating compartment and the temperature outside the refrigerating compartment with the set reference temperature to control a driving of the air curtain fan; and f) judging whether a closed door for the refrigerating compartment is detected to control the air curtain fan according to a result of the detection.

2. The method as defined in claim 1, in step e), when the calculated absolute value is greater than the set reference temperature judging whether a door-close is detected, and when the calculated absolute value is less than or equal to the set reference temperature driving the air curtain fan.

3. A method for controlling of driving an air curtain fan, said method comprising the steps of:

i) setting a reference temperature for controlling a temperature inside a refrigerating compartment of a refrigerator;

ii) executing the normal cool operating for the freezer compartment;

iii) judging whether an open door for the refrigerating compartment is detected during a normal cooling operating;

iv) executing step ii) when the door-open is detected, and detecting a temperature inside a refrigerating compartment and a temperature out side the refrigerating compartment when the door-close is detected, as a result of the detection in step iii);

v) comparing an absolute value of a difference between the temperature inside a refrigerating compartment and the temperature outside the refrigerating compartment with the set reference temperature to control a driving of the air curtain fan; and vi) judging whether a door-close for the refrigerating compartment is detected, executing step v) when the door-open is detected, and stopping the air curtain when the door-close is detected as a result of the detection.

4. The method as defined in claim 3, in step v), when the calculated absolute value is greater than the set reference temperature judging whether a door-close is detected, and when the calculated absolute value is less than or equal to the set reference temperature driving the air curtain fan.

5. An apparatus for controlling a driving of an air curtain fan, said apparatus comprising:

a temperature set section for setting a reference temperature for controlling a temperature inside a refrigerating compartment of a refrigerator;

a door detector for detecting an open/close state of a door of the refrigerating compartment;

first and second temperature detectors for detecting the temperature inside the refrigerating compartment and a temperature outside the refrigerating compartment, respectively;

an air curtain driver for controlling a driving of the air curtain fan;

a control section for executing a normal cool operating of the refrigerating compartment, judging whether the door detector detects an open door during the normal cooling operation, calculating an absolute value of a difference between the temperature inside the refrigerating compartment and the temperature outside the refrigerating compartment based on the temperatures inside and outside the refrigerating compartment detected by said first and second temperature detectors, respectively, comparing the calculated absolute value with the reference temperature set by said temperature set section to control an operation of said air curtain fan driver according to the comparison result.

6. The apparatus as defined in claim 5, wherein when the calculated absolute value is greater than the set reference temperature said conrol section stops said air curtain fan, and when the calculated absolute value is less than or equal to the set reference temperature said control section controls drive said air curtain fan.

* * * * *